United States Patent [19]

Gellatly

[11] 4,421,126

[45] Dec. 20, 1983

[54] PROCESS FOR UTILIZING TOBACCO FINES IN MAKING RECONSTITUTED TOBACCO

[75] Inventor: Grant Gellatly, Chester, Va.

[73] Assignee: Philip Morris Incorporated, New York, N.Y.

[21] Appl. No.: 270,450

[22] Filed: Jun. 4, 1981

[51] Int. Cl.[3] ..... A24B 3/14

[52] U.S. Cl. ..... 131/371; 131/372; 131/373; 131/374

[58] Field of Search ..... 131/370, 374, 371, 373, 131/372, 375, 353, 354, 355, 356, 357

[56] References Cited

U.S. PATENT DOCUMENTS

| | | | |
|---|---|---|---|
| 2,433,877 | 1/1948 | Wells et al. . | |
| 3,012,915 | 12/1961 | Howard | 131/354 |
| 3,076,729 | 2/1963 | Garbo | 131/354 |
| 3,496,255 | 2/1970 | Erxleben et al. . | |
| 3,628,541 | 12/1971 | Buchmann et al. . | |

FOREIGN PATENT DOCUMENTS

| | | | |
|---|---|---|---|
| 569171 | 1/1959 | Canada | 131/354 |
| 817832 | 8/1959 | United Kingdom | 131/354 |

*Primary Examiner*—V. Millin

*Attorney, Agent, or Firm*—Arthur I. Palmer, Jr.; D. Anthony Gregory; George E. Inskeep

[57] ABSTRACT

A process for employing tobacco fines in a system for preparing reconstituted tobacco is disclosed. The tobacco fines are incorporated into concentrated extract before the extract is recombined with the reconstituted sheet or into an aqueous carrier. The slurry of fines in extract or other carrier is passed through a homogenizer and then is applied as a coating to the sheet. The further drying and shredding are done in the conventional way.

6 Claims, 1 Drawing Figure

PROCESS FOR UTILIZING TOBACCO FINES IN MAKING RECONSTITUTED TOBACCO

BACKGROUND OF THE INVENTION

1. Field of the Invention

This invention pertains to the field of smoking materials. More particularly, the present invention concerns a method for preparing a smoking material with reconstituted tobacco having incorporated therein fine tobacco dust.

2. Description of the Prior Art

As a result of treating, handling and shipping tobacco in its various forms, i.e., cigar wrappers or fillers, cigarets, smoking tobacco, etc., tobacco dust is generally formed. This dust, generally less than about 60 mesh in size, is recovered from air filters, tobacco screens and other like separating systems. Generally, it has been desirable to employ this tobacco dust in conjunction with other tobacco by-products, such as stems, stalks and leaf scraps resulting from the stripping of leaf tobacco, in the preparation of reconstituted tobacco material.

One process for making reconstituted tobacco sheets involves casting or forming a paste or slurry of refined tobacco by-products, including dust, onto a moving belt. In such a technique, the employment of very fine tobacco particles is feasible inasmuch as these tobacco dust particles are simply retained on the moving belt, present no manufacturing difficulties are not lost during the sheet formation. This is not, however, true in a paper-making type process for the preparation of reconstituted tobacco.

More particularly, when employing a paper-making process for preparing reconstituted tobacco, the tobacco dust must generally be discarded or employed elsewhere. This is due to the fact that in the paper-making process, the slurry of refined tobacco by-products is cast from a head box onto a wire screen for forming the desired sheet. If the screen mesh size is too large, the dust particles simply pass through the wire screen and do not, as a result, become incorporated in the resulting sheet. Conversely, when the screen mesh size is reduced so as to prevent the tobacco dust particles from passing therethrough, the dust considerably slows the drainage of the water through the screen and correspondingly slows the rate of sheet formation by actually plugging and/or clogging the wire screen openings.

Accordingly, although the paper-making type process for making reconstituted tobacco material has many advantages over the alternative casting/moving belt method, particularly, in that a binder is not required to hold the fibers together and a significant amount of solubles can be removed from the tobacco material to be treated separately and later reincorporated in the resulting sheet, and is consequently the preferred method, it nevertheless does suffer from the disadvantage of not being able to efficiently and conveniently employ tobacco dust by-product. A means for employing tobacco dust in such a process is described in copending application Ser. No. 223,035 assigned to the assignee of the present application, but that means is somewhat complex and consequently more costly than that about to be disclosed.

SUMMARY OF THE INVENTION

Applicant has discovered a process which avoids substantially all of the above-noted disadvantages associated with a paper-making type process in the preparation of reconstituted tobacco containing tobacco dust which is employed as a smoking material alone or in combination with other smoking materials such as natural leaf tobacco.

In particular, applicant has discovered a method for producing a smoking material which economically utilizes tobacco dust by-products in a paper-making type process for making reconstituted tobacco. This method not only reduces the loss of the dust through the wire screen when the screen openings are too large and furthermore reduces clogging and/or plugging of the screen openings when these openings are too small, but additionally, the method of the present invention actually increases the rate of drainage through the wire screen correspondingly increasing the rate of production of the reconstituted tobacco sheet and improving its quality by allowing better refining of the remaining tobacco stem feedstock.

More particularly, the present invention is directed to a method for employing tobacco dust in the preparation of reconstituted tobacco which comprises admixing tobacco dust with the extract liquor which has been concentrated in steam evaporators after recovery from extraction presses. The mixture is then passed through a homogenizer to refine and uniformly disperse the particles in the concentrated extract. The viscous product is applied to the reconstituted tobacco web which has been removed from the Fourdrinier wire, and the coated web is then dried in the usual fashion. Final cutting, shredding, and blending into cigarette filler or the like is conventional. The method is diagrammed in FIG. 1.

DETAILED DESCRIPTION OF THE INVENTION

Figure 1:
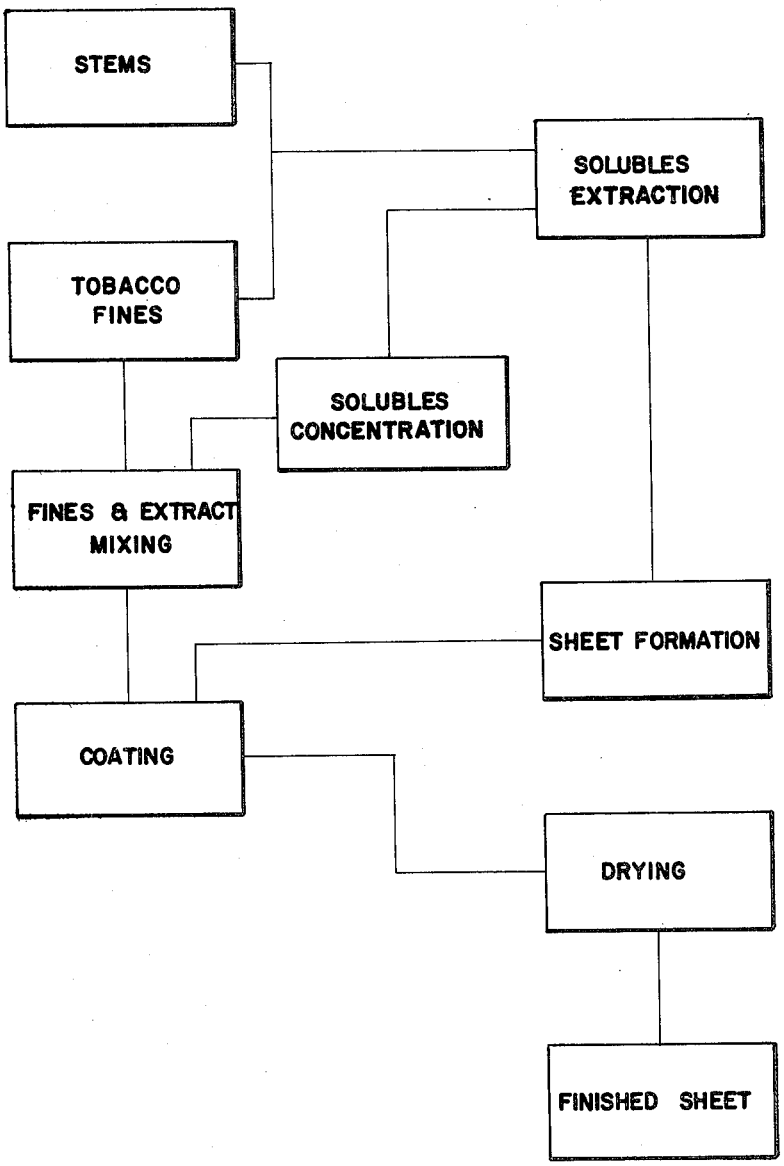

The method for utilizing tobacco fines in the preparation of reconstituted tobacco employing a paper-making process calls for certain modifications in the usual process.

Tobacco fines by-product material is first collected. It may be used totally apart from the Fourdrinier feedstock, or a portion (up to 20% of the feedstock) may be sent with the stems while the remainder is kept for the coating preparation. This separated fines fraction is blended with concentrated extract as will be described below.

Meanwhile, the said feedstock, according to the usual process, is diluted with 500 to 700 parts of water per 100 parts of solids and is passed into refiners which beat the stems to form a smooth, well-blended fiber slurry. This is concentrated in an extraction press by removal of about five-sixths of the liquid extract which is sent to the concentrators. Here steam heating vaporizes a portion of the water.

The stock from the press is diluted with white-water from the Fourdrinier to a consistency which is suitable for application to the wire at the headbox of the Fourdrinier. That part of the process is conventional in the extract-recombine papermaking reconstitution process.

The concentrated extract, according to the present invention, is blended with the separated fines fraction in preparation of a coating for reapplication, by any of the following alternatives:

1. The blend of concentrate and fines is homogenized, as for example in a Gaulin homogenizer or the like;

or the dry fines are milled prior to mixing with the extract;

2. The fines, before blending, are treated with aqueous diammonium phosphate to release the tobacco pectins and the resulting dispersion is blended with the extract (in a more concentrated form to allow for the dilution which results); or
3. The fines are moistened with water and treated with steam to soften and loosen the particles, resulting in a thick paste which is then blended with concentrated extract, and optionally homogenized as under (1) for preparation of a coating composition.

The coating is applied to the moving web ahead of the dryers, at or near the point where the sizing press is located in the basic process. The application may be by a roll coater, blade coater, high-pressure spray, or any similar means for applying viscous liquid to a running web. When dry, the reconstituted tobacco sheet is not sticky and does not shed dust before, during, or after cutting, to any greater degree than the conventional reconstituted product. With any of the methods, the maximum particle size is about 50 microns. It is desirable, but not essential to have an average particle size of the fines not greater than 10 microns and a maximum particle size of 20 microns; a preferred average particle size is not greater than 4 microns.

When the paper-making process does not involve a separate reapplication of the tobacco solubles as discussed above, for example, the process of U.S. Pat. No. 3,415,253, the fines may be dispersed in water in place of extract and applied after one of the three alternative treatments described. The addition of a gum to the water is optional.

The term "cylinder volume" is a measure of the relative filling power of tobacco or reconstituted tobacco for making smoking products. The term "oven volatiles" describes a measure of the approximate moisture content (or percentage of moisture) in tobacco. As used throughout this application, the values employed to characterize reconstituted tobacco, in connection with these terms, are determined as follows:

Oven-Volatiles Content (OV)

The sample of tobacco or reconstituted tobacco is weighed before and after exposure for 3 hours in a circulating air oven controlled at 100° C. (212° F.). The weight loss as percentage of initial weight is oven-volatiles content.

Equilibrium OV and Equilibration

The OV after equilibrium has significance in comparing properties of smoking materials at the same conditions. Materials are, generally, equilibrated (reordered) at conditions which are well known in the trade. Equilibrating is preferably done at standard conditions, which generally involve maintaining the tobacco at a temperature of 75° F. and 60% RH (relative humidity) for at least 18 hours.

Hot-Water Solubles (HWS)

This is a straightforward measurement of the weight loss from a sample boiled in water for an hour and filtered.

The process of the invention is illustrated by the following examples:

EXAMPLE I

Reconstituted tobacco was made by an extract-recombine papermaking process from a stem and fines feedstock containing approximately 37% by weight of fines. This will be considered the control. In a similar operation approximately 54% of the fines was withdrawn from the feedstock and the web was prepared while the extract liquor was diverted from the sizing press. The fines which had been withdrawn were combined with the extract liquor which had first been concentrated to approximately 45% solubles, and the combination was passed through a Gaulin homogenizer. The product was applied by a blade coater at various loadings to one side of the reconstituted sheet which was then passed through the drying system and shredded as filler. It was observed that the coating did not appreciably impregnate the web, but remained essentially on the surface where applied. Test results and OV and solubles analysis are given in Table I. Some web was also coated on both sides.

EXAMPLE II

With a papermaking process all fines were withdrawn from feestock. They were blended into concentrated extract liquor together with diammonium phosphate to release the pectins from the tobacco material. After thorough blending, the product was coated with the combined material by blade coater on one side of the web and the product dried in the usual way. The reconstituted filler from this process did not show a loss in filling power in spite of the build-up of solids on the sheet.

TABLE I

CHARACTERISTICS OF SIZED AND COATED RECONSTITUTED SHEET BY PAPERMAKING PROCESS

| | EXAMPLE I | | | | | EXAMPLE II |
|---|---|---|---|---|---|---|
| | Control | One-Sided Coating | | | Two-Sided Coating | One-Sided Coating |
| Weight (g/sq ft) | 9.3 | 9.5 | 12.1 | 18.4 | 14.1 | 9.9 |
| Thickness (mils) | 9.7 | 12.3 | 9.1 | 15.7 | 11.7 | 9.4 |
| Longs (%) | 2.5 | 1.9 | 2.0 | 4.2 | 2.6 | 1.8 |
| Tensile (kg/in) | 1.85 | 3.04 | 2.94 | 2.05 | 3.04 | 2.96 |
| Equil. OV (%) | 13.1 | 12.1 | 13.0 | 13.3 | — | 12.4 |
| CV (cc/10 g) | 36.9 | 41.7 | 34.8 | 31.7 | — | 40.1 |
| Hot water solubles | 43.0 | 36.0 | 46.0 | 56.0 | — | 49.0 |

What is claimed is:

1. A method for employing tobacco fines in the preparation of reconstituted tobacco which comprises:
   (a) separating fines from a feedstock to a reconstitution process,
   (b) slurrying and refining the feedstock absent the separated fines in an aqueous medium, and removing from the refined slurry the greater part of the liquid phase and replacing it with white water from step (c),
   (c) supplying the refined slurry to a paper making machine for preparing reconstituted tobacco sheet and forming a sheet therefrom, and recovering white water from said machine, (d) combining the separated fines from step (a) with a second aqueous medium, (e) treating the combination from step (d) to form a uniform dispersion of the fines, and (f) applying the dispersion from step (e) as a coating to the sheet from step (c) before said sheet is introduced to dryers.

2. The method of claim 1 wherein the second aqueous medium of step (d) is concentrated liquid phase removal in step (b).

3. The method of claim 1 wherein the applying of step (f) is performed with a coating roll or a coating blade.

4. The method of claim 1 wherein the treatment of step (e) is a homogenizing.

5. The method of claim 4 wherein the homogenizing reduces the dimensions of undissolved fines to less than 50 microns.

6. The method of claim 1 wherein the treatment of step (e) is the introduction of diammonium phosphate with stirring.

* * * * *